US010585385B2

(12) United States Patent
Taniguchi

(10) Patent No.: US 10,585,385 B2
(45) Date of Patent: Mar. 10, 2020

(54) IMAGE FORMING APPARATUS

(71) Applicant: KYOCERA Document Solutions Inc., Osaka (JP)

(72) Inventor: Susumu Taniguchi, Osaka (JP)

(73) Assignee: KYOCERA Documents Solutions Inc., Osaka (JP)

( * ) Notice: Subject to any disclaimer, the term of this patent is extended or adjusted under 35 U.S.C. 154(b) by 0 days.

(21) Appl. No.: 16/190,196

(22) Filed: Nov. 14, 2018

(65) Prior Publication Data

US 2019/0163111 A1 May 30, 2019

(30) Foreign Application Priority Data

Nov. 29, 2017 (JP) ..... 2017-228655

(51) Int. Cl.

| | |
|---|---|
| ***B65H 37/00*** | (2006.01) |
| ***G03G 21/16*** | (2006.01) |
| ***B65H 29/52*** | (2006.01) |
| ***B65H 29/58*** | (2006.01) |
| ***B65H 29/60*** | (2006.01) |
| ***B65H 37/04*** | (2006.01) |
| ***B65H 39/00*** | (2006.01) |
| ***B65H 39/10*** | (2006.01) |

(52) U.S. Cl.

CPC ..... *G03G 21/1619* (2013.01); *B65H 29/52* (2013.01); *B65H 29/58* (2013.01); *B65H 29/60* (2013.01); *B65H 37/00* (2013.01); *B65H 37/04* (2013.01); *B65H 39/00* (2013.01); *B65H 39/10* (2013.01); *G03G 2221/1696* (2013.01)

(58) Field of Classification Search

CPC ..... B65H 29/58; B65H 29/60; B65H 37/00; B65H 37/04; B65H 39/00; B65H 39/10; B65H 2801/24; B65H 2801/27

See application file for complete search history.

(56) References Cited

U.S. PATENT DOCUMENTS

| | | | | |
|---|---|---|---|---|
| 6,928,251 | B2 | 8/2005 | Yoshihara et al. | |
| 2004/0095456 | A1 | 5/2004 | Yoshihara et al. | |
| 2013/0043637 | A1* | 2/2013 | Awano | B42B 5/08 270/58.08 |
| 2017/0282483 | A1* | 10/2017 | Makita | B31F 1/07 |
| 2017/0283204 | A1* | 10/2017 | Awano | B31F 5/02 |

FOREIGN PATENT DOCUMENTS

JP 2004-077788 A 3/2004

* cited by examiner

*Primary Examiner* — David H Bollinger

(74) *Attorney, Agent, or Firm* — Studebaker & Brackett PC

(57) ABSTRACT

An image forming apparatus includes an optional device, a casing, an image forming section and a sheet conveyor device. The optional device performs optional processing. The image forming section is located inside of the casing and forms an image on a sheet. The sheet conveyor device conveys, to the optional device, the sheet with an image formed thereon by the image forming section. The optional device and the casing are fixed to each other. The sheet conveyor device is fixed to the optional device and the casing.

10 Claims, 14 Drawing Sheets

IMAGE FORMING APPARATUS

INCORPORATION BY REFERENCE

The present application claims priority under 35 U.S.C. § 119 to Japanese Patent Application No. 2017-228655, filed on Nov. 29, 2017. The contents of this application are incorporated herein by reference in their entirety.

BACKGROUND

The present disclosure relates to an image forming apparatus.

An example of an image forming apparatus has high rigidity. In detail, the image forming apparatus includes a left frame and a right frame. Each frame is box-shaped. Each frame includes a plate surface and four side surfaces. The four side surfaces extend in a direction perpendicular to the plate surface from four edges of the plate surface as base ends. Each side surface is joined with adjacent side surfaces. Accordingly, the strength of each frame increases, thus increasing the rigidity of the image forming apparatus.

SUMMARY

An image forming apparatus according to an aspect of the present disclosure includes an optional device, a casing, an image forming section and a sheet conveyor device. The optional device performs optional processing. The image forming section is located inside of the casing and forms an image on a sheet. The sheet conveyor device conveys, to the optional device, the sheet with an image formed thereon by the image forming section. The optional device and the casing are fixed to each other. The sheet conveyor device is fixed to the optional device and the casing.

DETAILED DESCRIPTION

Figure 1:
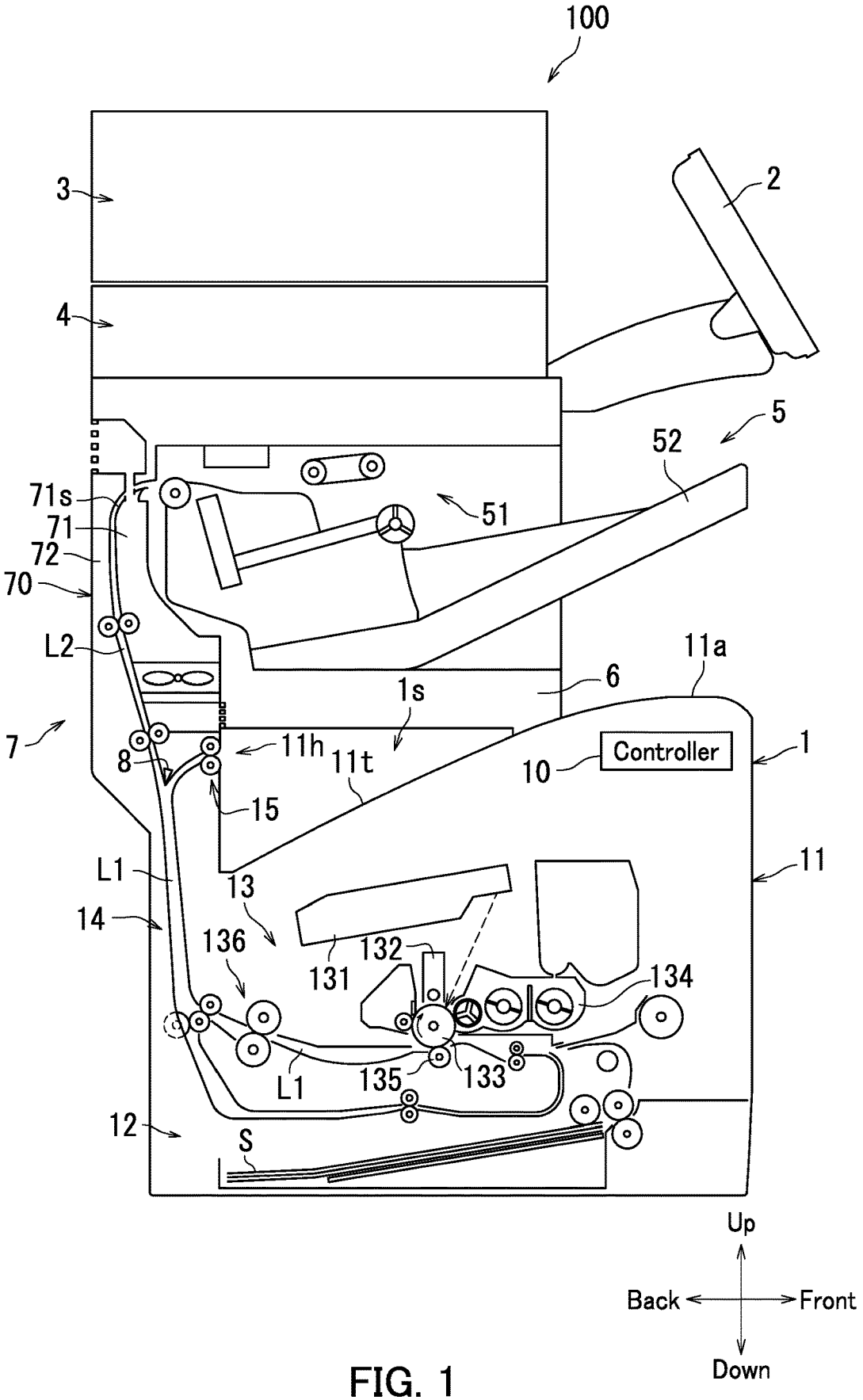
FIG. 1 is a diagram illustrating a configuration of an image forming apparatus according to an embodiment of the present disclosure.

In the following, an embodiment of an image forming apparatus according to the present disclosure is described with reference to the accompanying drawings. Note that elements that are the same or equivalent are labeled with the same reference signs in the drawings and description thereof will not be repeated.

First, a configuration of an image forming apparatus 100 according to the present embodiment is described with reference to FIG. 1. FIG. 1 is a diagram illustrating an outer appearance of the image forming apparatus 100 according to the present embodiment.

As illustrated in FIG. 1, the image forming apparatus 100 includes a printer 1, an operation panel 2, a document conveyor device 3, a reading device 4, a finisher 5, a coupling member 6, a sheet conveyor device 7, a flapper 8, and a controller 10. In the present embodiment, the image forming apparatus 100 is a multifunction peripheral in which the finisher 5 is attached to the printer 1. The finisher 5 is an example of an optional device.

The image forming apparatus 100 has an in-body space 1*s*. The in-body space 1*s* is surrounded by the printer 1 and the finisher 5.

In the following, the present embodiment is described assuming that a front side of the image forming apparatus 100 is a side on which the operation panel 2 is located, and a back side of the image forming apparatus 100 is a side opposite to the front side. The present embodiment is also described assuming that a right side of the image forming apparatus 100 is a side on the right when viewed from the front side of the image forming apparatus 100, and a left side of the image forming apparatus 100 is a side opposite to the right side. The present embodiment is further described assuming that an upper side of the image forming apparatus 100 is a side on which the document conveyor device 3 is located in a direction orthogonal to a front-back direction and a left-right direction of the image forming apparatus 100, and a lower side of the image forming apparatus 100 is a side opposite to the upper side.

The printer 1 forms an image on a sheet S. The printer 1 is located in a lower portion of the image forming apparatus 100. The printer 1 includes a main body casing 11. The main body casing 11 is substantially rectangular parallelepiped-shaped. Note that the main body casing 11 is an example of a casing.

The printer 1 has a configuration of a general printer. In detail, the printer 1 further includes a sheet feeding device 12, an image forming section 13, a sheet conveying mechanism 14, an ejection section 15, and a main body exit tray 11*t*. The sheet feeding device 12, the image forming section 13, the sheet conveying mechanism 14, and the ejection section 15 are housed inside of the main body casing 11.

The sheet feeding device 12 houses a plurality of sheets S, and feeds the housed sheets S one by one.

The image forming section 13 forms an image on a sheet S. In the present embodiment, the image forming section 13 electrographically forms an image on the sheet S. The image forming section 13 includes a light exposure device 131, a charger 132, a photosensitive drum 133, a development device 134, a transfer device 135, and a fixing device 136.

The sheet conveying mechanism 14 conveys the sheet S fed from the sheet feeding device 12 to the flapper 8 by way of the image forming section 13. The sheet conveying mechanism 14 includes a plurality of rollers and guide members to form a first sheet conveyance path L1. An upstream end of the first sheet conveyance path L1 is connected to the sheet feeding device 12. A downstream end of the first sheet conveyance path L1 is connected to the ejection section 15 and the sheet conveyor device 7.

The ejection section 15 ejects the sheet S to the main body exit tray 11*t* through a sheet exit port 11*h*. The sheet exit port 11*h* is in a location facing the in-body space is in the main body casing 11. The main body exit tray 11*t* serves as an upper surface 11*a* of the main body casing 11. In other words, the main body exit tray 11*t* serves as a lower surface of the in-body space 1*s*. A plurality of sheets S can be loaded on the main body exit tray 11*t*. In the following, a maximum number of sheets S that can be loaded on the main body exit tray 11*t* may be referred to as a "maximum sheet loading capacity".

The operation panel 2 receives instruction from a user for the image forming apparatus 100. In the present embodiment, the operation panel 2 is a touch panel.

The document conveyor device 3 conveys a sheet-shaped document. The document conveyor device 3 includes a document loading tray, a document exit tray, and a document conveying section. The document conveying section conveys the document loaded on the document loading tray sheet by sheet to the document exit tray by way of a reading position. The reading position is a position at which the reading device 4 reads the document. The document conveyor device 3 is located on the reading device 4.

The reading device 4 reads an image from the document and outputs read image data. The reading device 4 includes a document table and a reading mechanism. The reading mechanism reads an image from a document loaded on the document table and outputs the read image data. Alternatively, the reading mechanism reads an image from a document passing the reading position and outputs read image data. In the present embodiment, the reading device 4 is a scanner. The reading device 4 is located above the finisher 5.

The finisher 5 performs optional processing on a sheet S. The optional processing includes hole punching, stapling, and alignment. The finisher 5 is located above the main body casing 11 (printer 1).

The finisher 5 includes an optional processing section 51 and an optional exit tray 52. The optional processing section 51 includes a puncher, a processing tray, and a stapler, for example. The puncher performs hole-punching processing on a sheet S. The stapler performs stapling processing on a plurality of sheets S (a sheet sheaf) loaded on the processing tray. A sheet S on which optional processing has been performed is ejected to the optional exit tray 52.

The coupling member 6 is located between the printer 1 and the finisher 5, and couples the finisher 5 to the printer 1. In other words, the finisher 5 is connected to the printer 1 through the coupling member 6. The coupling member 6 is provided to increase the maximum sheet loading capacity of the main body exit tray 11*t*.

The sheet conveyor device 7 conveys, to the finisher 5, a sheet S that has been conveyed from the sheet conveying mechanism 14. In detail, the sheet conveyor device 7 includes a conveyor device casing 70, a first guide member 71, and a second guide member 72. The first guide member 71 and the second guide member 72 are located inside of the conveyor device casing 70. The first guide member 71 and the second guide member 72 are located opposite to each other and constitute a second sheet conveyance path L2. An upstream end of the second sheet conveyance path L2 is connected to the downstream end of the first sheet conveyance path L1. A downstream end of the second sheet conveyance path L2 is connected to the finisher 5.

The first guide member 71 and the second guide member 72 guide conveyance of the sheet S. The first guide member 71 has a guide surface 71*s* which guides the conveyance of the sheet S. The guide surface 71*s* faces the second guide member 72. The guide surface 71*s* also faces an image formation surface of the sheet S. The sheet S has two main surfaces, and the image formation surface is one of the main surfaces on which an image is formed by the image forming section 13. In the present embodiment, the first guide member 71 is made from a synthetic resin.

The flapper 8 is located at the downstream end of the first sheet conveyance path L1. The flapper 8 is freely pivotable. Due to pivoting of the flapper 8, a conveyance destination of the sheet S conveyed by the sheet conveying mechanism 14 is switched between the ejection section 15 and the second sheet conveyance path L2.

The controller 10 controls operation of each section of the image forming apparatus 100. The controller 10 is a processor such as a central processing unit (CPU). The controller 10 also includes integrated circuits for image formation processing. An integrated circuit for image formation processing is an application-specific integrated circuit (ASIC), for example. The controller 10 includes a storage area. The controller 10 controls the operation of each section of the image forming apparatus 100 by executing a control program stored in the storage area.

Next, a frame configuration of the image forming apparatus 100 according to the present embodiment is described with reference to FIGS. 2 to 8.

Figure 2:
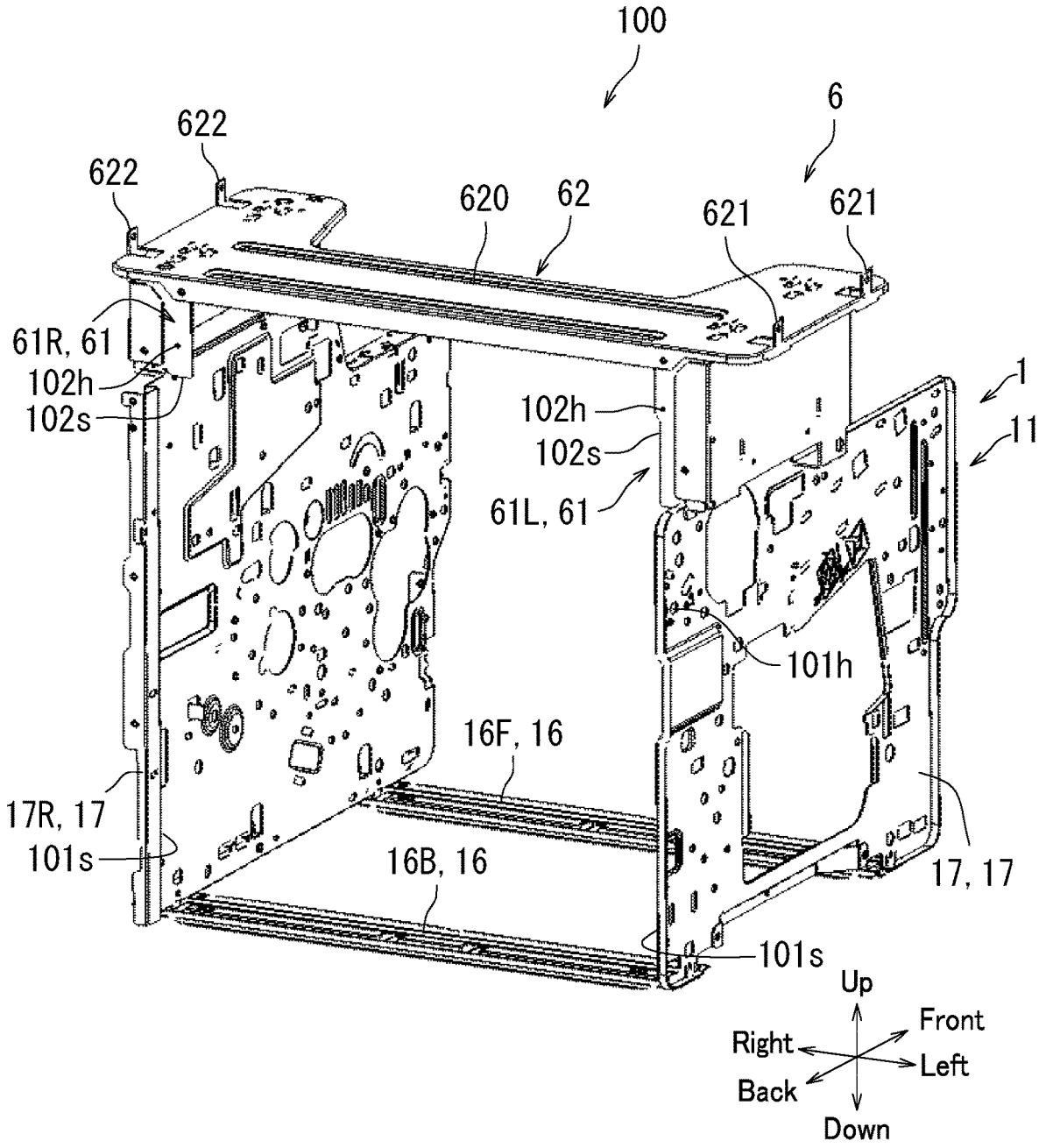
FIG. 2 is a perspective view illustrating a frame configuration of a main body casing and a coupling member according to the embodiment of the present disclosure.

First, a frame configuration of the main body casing 11 (printer 1) and the coupling member 6 according to the present embodiment is described with reference to FIG. 2. FIG. 2 is a perspective view illustrating the frame configuration of the main body casing 11 and the coupling member 6 according to the present embodiment. Note that FIG. 2 is a diagram in which the image forming apparatus 100 is viewed from the back left.

As illustrated in FIG. 2, the main body casing 11 includes two main body base plates 16 and two main body side plates 17.

The two main body base plates 16 are arranged along the main body casing 11 in the front-back direction. In the following, one of the two main body base plates 16 located on the front of the main body casing 11 may be referred to as a "front base plate 16F". The other of the main body base plates 16 located on the back of the main body casing 11 may be referred to as a "back base plate 16B". Each of the main body base plates 16 are long plate-shaped members.

The two main body side plates 17 are located on respective edge portions of the image forming apparatus 100 in the left-right direction. In the following, one of the two main body side plates 17 located on the left of the main body casing 11 may be referred to as a "left plate 17L". The other of the main body side plates 17 located on the right of the main body casing 11 may be referred to as a "right plate 17R". The left plate 17L and the right plate 17R are opposite to each other in the left-right direction. Note that the left plate 17L is an example of a first frame, and the right plate 17R is an example of a second frame.

Each of the main body side plates 17 is a flat plate-shaped member. The main body side plates 17 are connected to respective edge portions of the front base plate 16F and the back base plate 16B. In detail, a front edge portion of the left plate 17L is connected to a left edge portion of the front base plate 16F, and a back edge portion of the left plate 17L is connected to a left edge portion of the back base plate 16B. The left plate 17L stands from the left edge portions of the front base plate 16F and the back base plate 16B which serve as base ends thereof. A front edge portion of the right plate 17R is connected to a right edge portion of the front base plate 16F, and a back edge portion of the right plate 17R is connected to a right edge portion of the back base plate 16B. The right plate 17R stands from the right edge portions of the front base plate 16F and the back base plate 16B which serve as base ends thereof.

Each of the main body side plates 17 has a first mounting hole 101*h* and a first mounting surface 101*s*. The first mounting hole 101*h* is located in a back upper portion of each of the main body side plates 17. The first mounting surfaces 101*s* of the main body side plates 17 are opposite to each other in the left-right direction of the image forming apparatus 100.

The coupling member 6 includes two first coupling members 61 and a second coupling member 62.

The two first coupling members 61 are opposite to each other in the left-right direction of the image forming apparatus 100. In the following, one of the first coupling members 61 located on the left of the image forming apparatus 100 may be referred to as a "left coupling member 61L". The other of the first coupling members 61 located on the right of the image forming apparatus 100 may be referred to as a "right coupling member 61R". The left coupling member 61L is fixed to the left plate 17L. The right coupling member 61R is fixed to the right plate 17R.

Each of the first coupling members 61 has a second mounting hole 102*h* and a second mounting surface 102*s*. The second mounting holes 102*h* are located in the respective second mounting surfaces 102*s*. The second mounting surfaces 102*s* serve as respective back surfaces of the first coupling members 61.

The second coupling member 62 is located on the first coupling members 61 and is fixed to the first coupling members 61. In detail, the second coupling member 62 includes a base section 620, two first connecting sections 621, and two second connecting sections 622. The base section 620 is flatly plate-shaped and extends in the left-right direction of the image forming apparatus 100. A left edge portion of the base section 620 is fixed to the left coupling member 61L. A right edge portion of the base section 620 is fixed to the right coupling member 61R. Each of the first connecting sections 621 stands from the left edge portion of the base section 620 serving as base ends thereof. Each of the second connecting sections 622 stands from the right edge portion of the base section 620 serving as base ends thereof. Each of the first connecting sections 621 and the second connecting sections 622 has a through hole.

Figure 3:
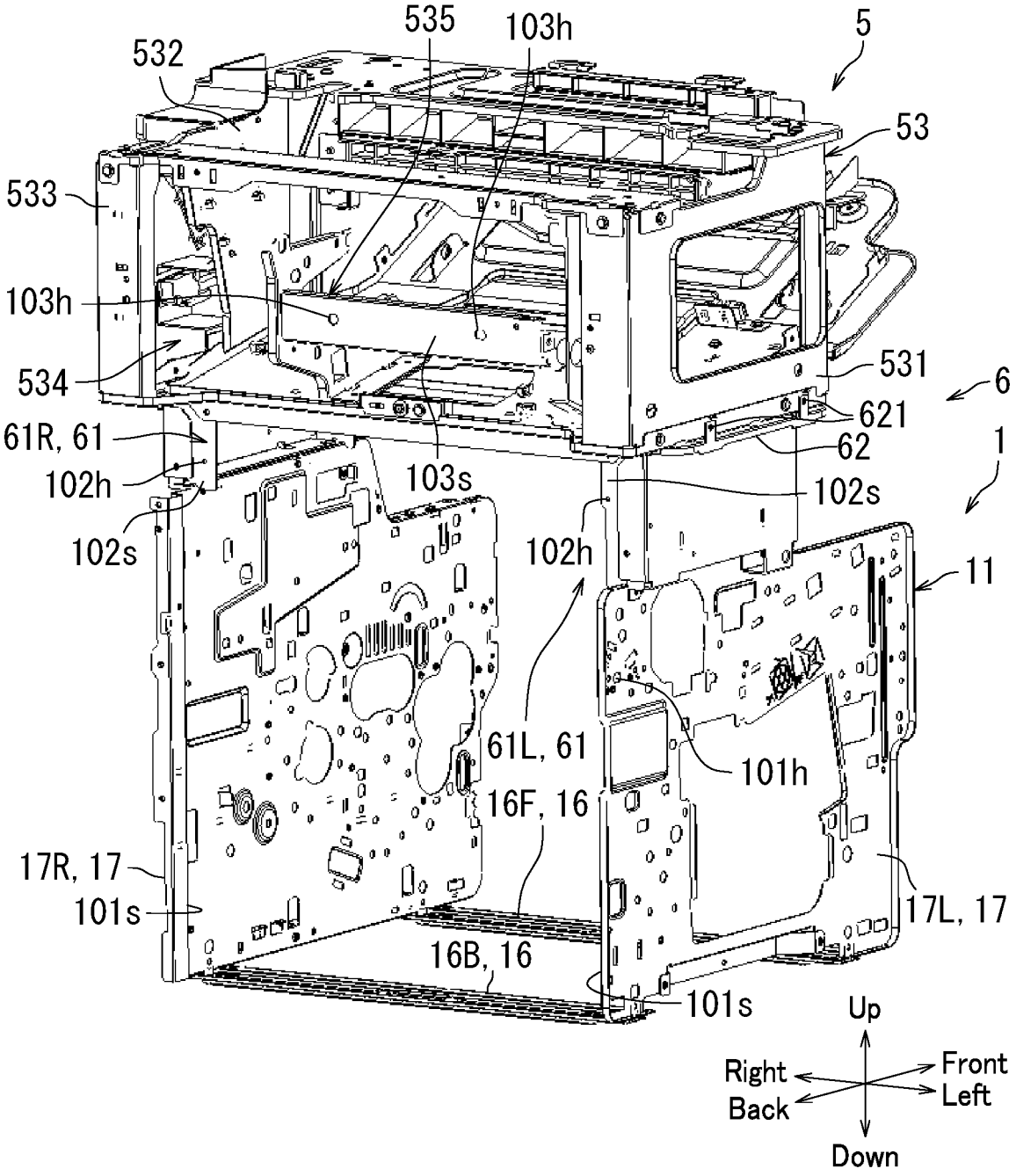
FIG. 3 is a perspective view illustrating a frame configuration of the main body casing, a finisher, and the coupling member according to the embodiment of the present disclosure.

Next, a frame configuration of the finisher 5 and the coupling member 6 will be described with reference to FIG. 3. FIG. 3 is a perspective view illustrating the frame configuration of the main body casing 11, the finisher 5, and the coupling member 6 according to the present embodiment. In detail, FIG. 3 illustrates a state in which the finisher 5 is fixed to the coupling member 6 illustrated in FIG. 2.

As illustrated in FIG. 3, the finisher 5 is fixed to the coupling member 6. In other words, the main body casing 11 (printer 1) and the finisher 5 are fixed to each other through the coupling member 6.

The finisher 5 has a substantially rectangular parallelepiped-shaped device frame 53. The device frame 53 has a first side wall 531, a second side wall 532, a third side wall 533, an opening 534, and a mounting section 535.

The first side wall 531 is provided on the left of the finisher 5. The first side wall 531 is connected to the first connecting sections 621 (coupling member 6). In detail, the first side wall 531 has screw holes. Screws inserted through the through holes of the first connecting sections 621 are threaded through the screw holes of the first side wall 531. Accordingly, the first side wall 531 and the first connecting sections 621 are fixed to each other.

The second side wall 532 is provided on the right of the finisher 5. The second side wall 532 is connected to the second connecting sections 622 (coupling member 6) described with reference to FIG. 2. In detail, the second side wall 532 has screw holes. Screws inserted through the through holes of the second connecting sections 622 are threaded through the screw holes of the second side wall 532. Accordingly, the second side wall 532 and the second connecting section 622 are fixed to each other.

The third side wall 533 is provided on the back of the finisher 5. The opening 534 is located in the third side wall 533.

The mounting section 535 is located between the first side wall 531 and the second side wall 532, and extends in the left-right direction of the image forming apparatus 100. The mounting section 535 has two third mounting holes 103*h* and a third mounting surface 103*s*.

Figure 4:
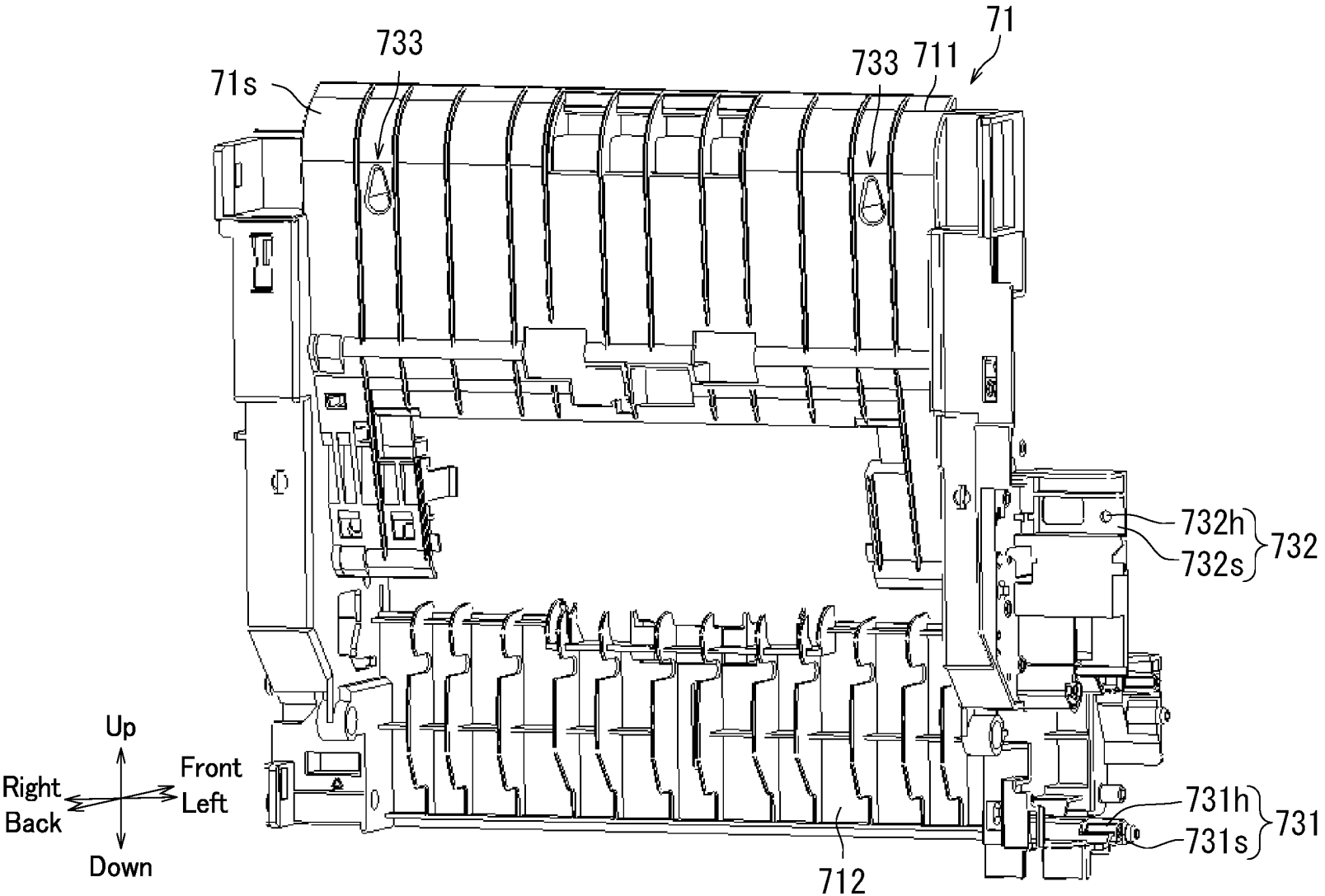
FIG. 4 is a perspective view illustrating a configuration of a first guide member according to the embodiment of the present disclosure.
Figure 5:
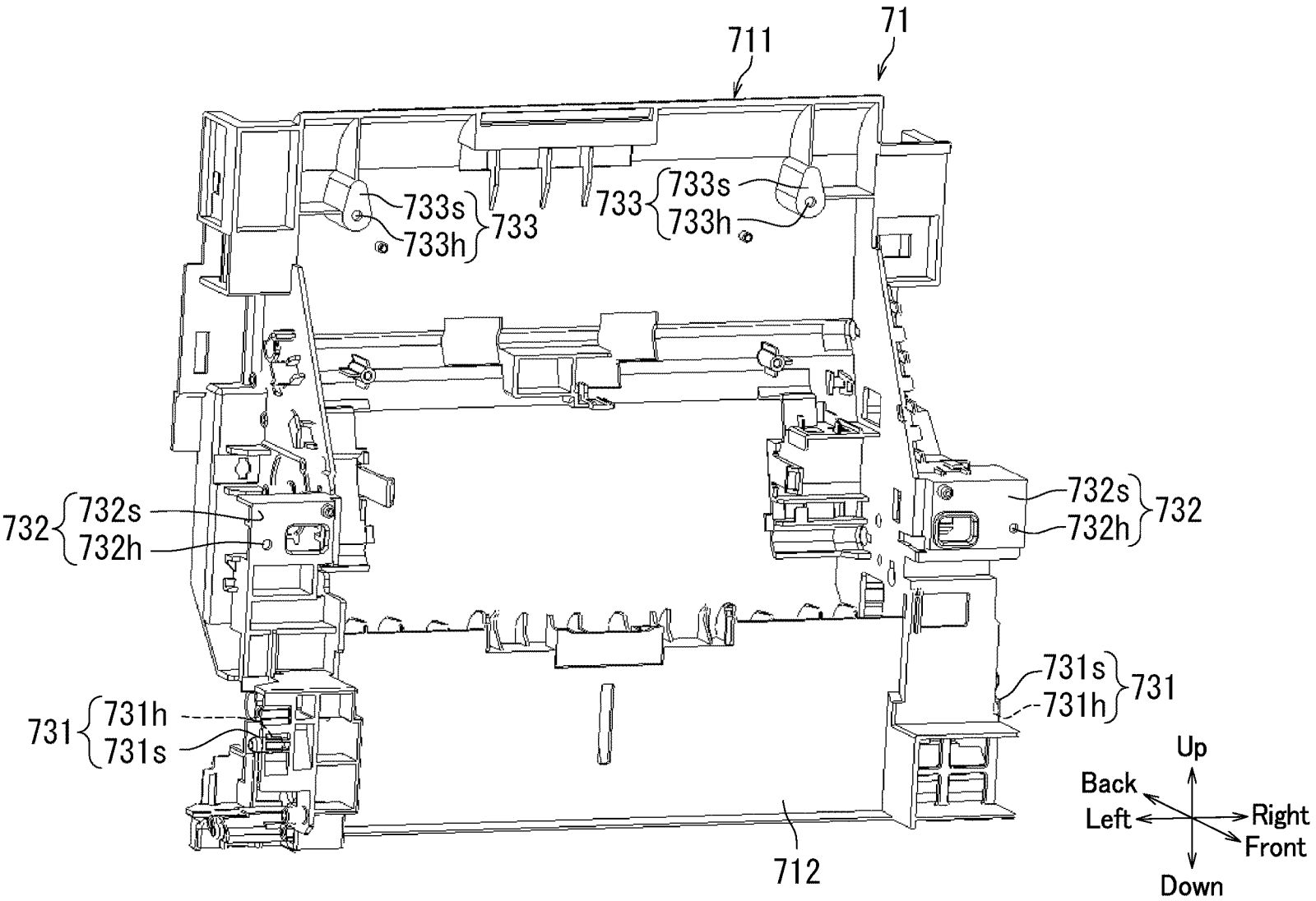
FIG. 5 is another perspective view illustrating the configuration of the first guide member according to the embodiment of the present disclosure.

Next, a configuration of the first guide member 71 according to the present embodiment will be described with reference to FIGS. 4 and 5. FIG. 4 is a perspective view illustrating the configuration of the first guide member 71 according to the present embodiment. FIG. 5 is another perspective view illustrating the configuration of the first guide member 71 according to the present embodiment. In detail, FIG. 4 illustrates the guide surface 71*s* of the first guide member 71 (refer to FIG. 2), and FIG. 5 illustrates a surface of a side of the first guide member 71 opposite to the guide surface 71*s*.

As illustrated in FIGS. 4 and 5, the first guide member 71 includes a first guide section 711 and a second guide section 712.

As illustrated in FIG. 5, the first guide member 71 has two first fastening sections 731, two second fastening sections 732, and two third fastening sections 733.

The two first fastening sections 731 are provided on a lower portion of the first guide member 71. The two first fastening sections 731 are provided on respectively opposite edge portions of the first guide member 71 in the left-right direction. The two first fastening sections 731 are opposite to each other in the first guide member 71 in the left-right direction.

Each of the first fastening sections 731 has a first fastening surface 731*s* and a first fastening hole 731*h*. A first fastening surface 731*s* is an example of a first opposing surface.

The first fastening surfaces 731*s* are opposite to the respective first mounting surfaces 101*s* of the main body side plates 17 (refer to FIG. 2). In detail, one of the two first fastening surfaces 731*s* located on the left is opposite to the first mounting surface 101*s* of the left plate 17L. The other of the two first fastening surfaces 731*s* located on the right is opposite to the first mounting surface 101*s* of the right plate 17R.

The first fastening holes 731*h* correspond to the respective first mounting holes 101*h* of the main body side plates 17 (refer to FIG. 2). In detail, one of the two first fastening holes 731*h* located on the left corresponds to the first mounting hole 101*h* of the left plate 17L. The other of the two first fastening holes 731*h* located on the right corresponds to the first mounting hole 101*h* of the right plate 17R. In the present embodiment, each of the first fastening holes 731*h* is a screw hole with a screw threaded therein.

The two second fastening sections 732 are provided on a central part of the first guide member 71 in an up-and-down direction. The two second fastening sections 732 are provided on respectively opposite edge portions of the first guide member 71 in the left-right direction.

Each of the second fastening sections 732 has a second fastening surface 732*s* and a second fastening hole 732*h*. The second fastening surfaces 732*s* are opposite to the respective second mounting surfaces 102*s* of the first coupling members 61 (refer to FIG. 2). In detail, one of the two second fastening surfaces 732*s* located on the left is opposite to the second mounting surface 102*s* of the left coupling member 61L. The other of the two second fastening surfaces 732*s* located on the right is opposite to the second mounting surface 102*s* of the right coupling member 61R. In the present embodiment, the two second fastening surfaces 732*s* are on the same level plane. The second fastening surfaces 732*s* are orthogonal to the first fastening surfaces 731*s*.

The second fastening holes 732*h* correspond to the respective second mounting holes 102*h* of the first coupling members 61 (refer to FIG. 2). In detail, one of the two second fastening holes 732*h* located on the left corresponds to the second mounting hole 102*h* of the left coupling member 61L. The other of the two second fastening holes 732*h* located on the right corresponds to the second mounting hole 102*h* of the right coupling member 61R. In the present embodiment, each of the second fastening holes 732*h* is a screw hole with a screw threaded therein.

The two third fastening sections 733 are provided on respectively opposite edge portions of the first guide section 711 in the left-right direction.

Each of the third fastening sections 733 includes a third fastening surface 733*s* and a third fastening hole 733*h*. The third fastening surface 733*s* is an example of a second opposing surface.

The two third fastening surfaces 733*s* are opposite to the third mounting surface 103*s* of the mounting section 535 (refer to FIG. 3). In the present embodiment, the two third fastening surfaces 733*s* are on the same level plane. A level plane of the first fastening surfaces 731*s* intersects with the level planes of the third fastening surfaces 733*s* and the second fastening surfaces 732*s*. In the present embodiment, the first fastening surfaces 731*s* are orthogonal to the third fastening surfaces 733*s* and the second fastening surfaces 732*s*.

The third fastening holes 733*h* correspond to the respective third mounting holes 103*h* of the device frame 53 (refer to FIG. 3). In detail, one of the third fastening holes 733*h* located on the left corresponds to one of the two third mounting holes 103*h* located on the left. The other of the two third fastening holes 733*h* located on the right corresponds to the other of the two third mounting holes 103*h* located on the right. In the present embodiment, the third fastening holes 733*h* are insertion holes with screws inserted therein.

Figure 6:
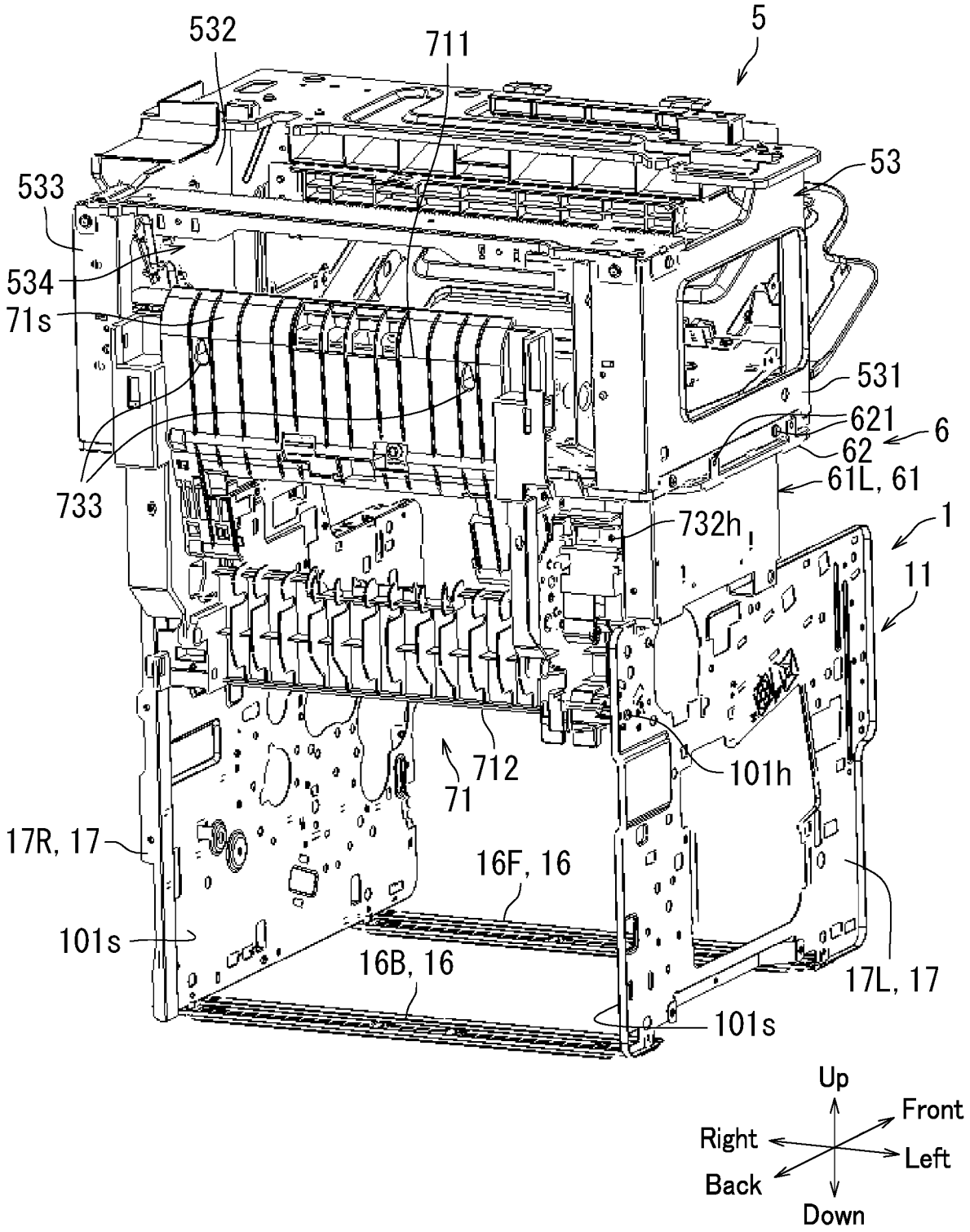
FIG. 6 is a perspective view illustrating a frame configuration of the main body casing, the finisher, the coupling member, and the first guide member according to the embodiment of the present disclosure.
Figure 7:
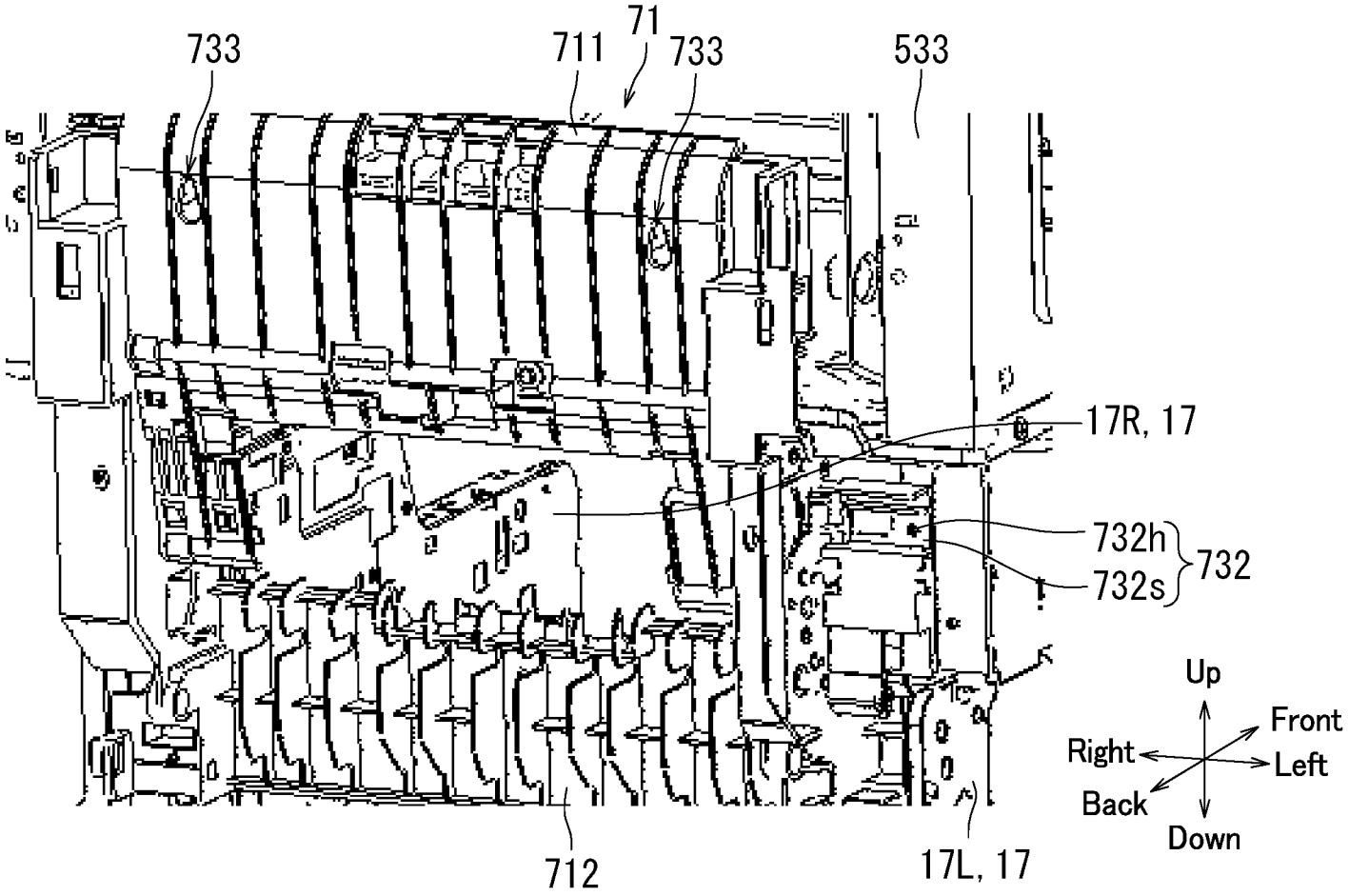
FIG. 7 is a diagram illustrating a region of the first guide member illustrated in FIG. 6.
Figure 8:
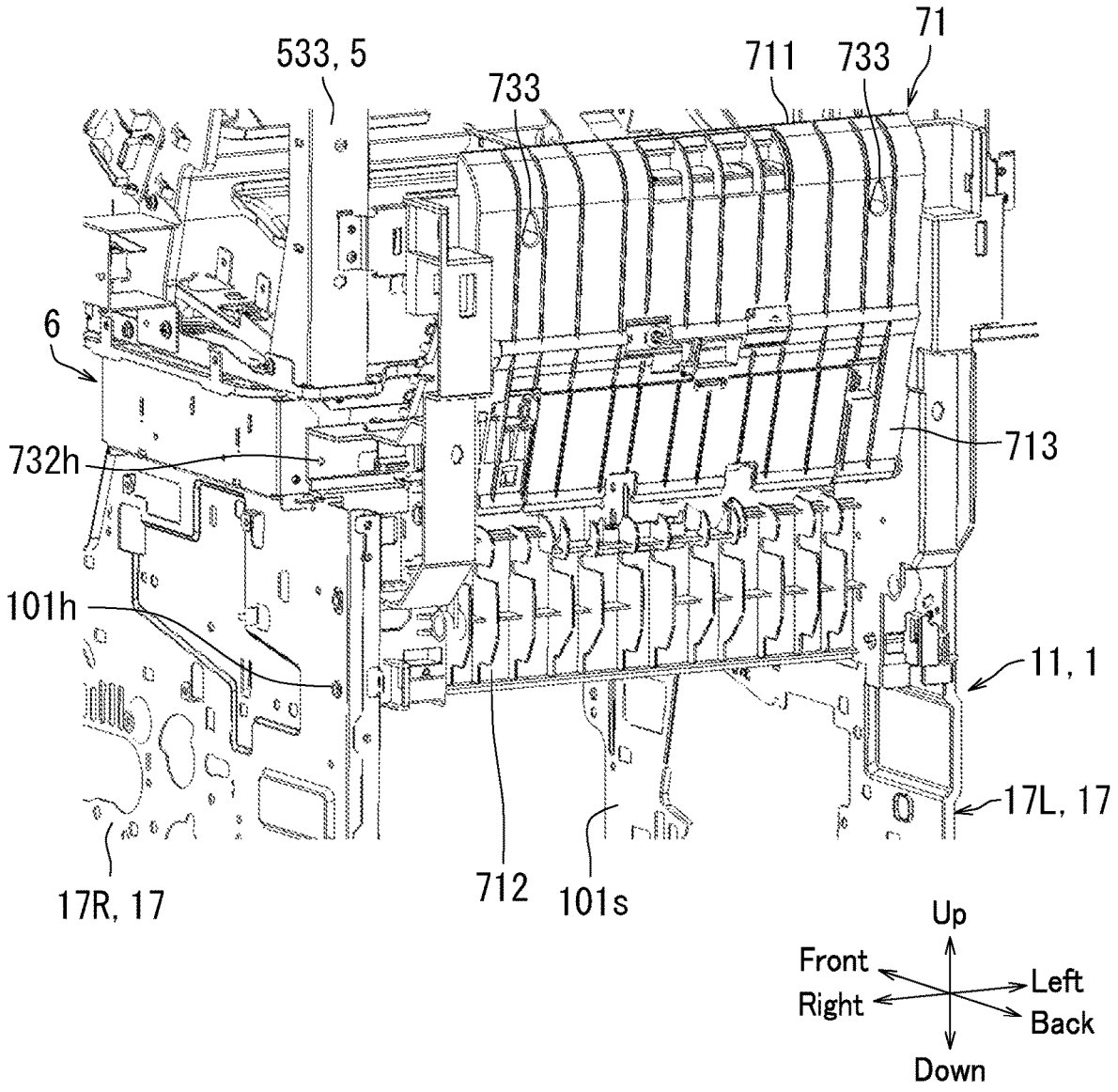
FIG. 8 is another perspective view illustrating the frame configuration of the main body casing, the finisher, the coupling member, and the first guide member according to the embodiment of the present disclosure.

Next, a frame configuration of the main body casing 11, the finisher 5, the coupling member 6, and the first guide member 71 is described with reference to FIGS. 6 to 8. FIG. 6 is a perspective view illustrating the frame configuration of the main body casing 11, the finisher 5, the coupling member 6, and the first guide member 71 according to the present embodiment. In detail, FIG. 6 illustrates a state in which the main body casing 11, the finisher 5, and the coupling member 6 illustrated in FIG. 3 are fixed to the first guide member 71. FIG. 7 is a diagram illustrating a region of the first guide member 71 illustrated in FIG. 6. FIG. 8 is another perspective view illustrating the frame configuration of the main body casing 11, the finisher 5, the coupling member 6, and the first guide member 71 according to the present embodiment.

As illustrated in FIGS. 6 to 8, the first guide member 71 is fixed to the main body casing 11, the finisher 5, and the coupling member 6.

In detail, the screws inserted through the first mounting holes 101*h* are threaded into the first fastening holes 731*h* (refer to FIG. 5). Accordingly, the first guide member 71 is fastened together with the printer 1, thus fixing the first guide member 71 and the printer 1 to each other.

The screws inserted into the second fastening holes 732*h* are threaded into the second mounting holes 102*h* (refer to FIG. 2). Accordingly, the first guide member 71 is fastened together with the first coupling member 61, thus fixing the first guide member 71 and the coupling member 6 to each other.

The screws inserted into the third fastening holes 733*h* of the third fastening sections 733 (refer to FIG. 5) are threaded into the third mounting holes 103*h* (refer to FIG. 3). Accordingly, the first guide member 71 is fastened together with the finisher 5, thus fixing the first guide member 71 and the finisher 5 to each other.

The first guide member 71 according to the present embodiment is located so as to be orthogonal to the left plate 17L and the right plate 17R, and left and right edge portions of the first guide member 71 are respectively fixed to the left plate 17L and the right plate 17R. In other words, the first guide member 71 defines a distance between the left plate 17L and the right plate 17R. Accordingly, swaying of the left plate 17L and the right plate 17R in the left-right direction can be restricted. As a result, rigidity of the main body casing 11 can be increased.

The first guide member 71 according to the present embodiment is fixed to the main body casing 11 (printer 1), the finisher 5, and the coupling member 6. In other words, the printer 1, the finisher 5, the coupling member 6, and the first guide member 71 are fixed together as one unit. Accordingly, the image forming apparatus 100 can have high rigidity as compared to a configuration in which the first guide member 71 is only fixed to the printer 1, for example.

Furthermore, the first guide member 71 according to the present embodiment has a function of reinforcing the frame configuration of the image forming apparatus 100 in addition to a function of guiding conveyance of the sheet S. Accordingly, the number of components in the image forming apparatus 100 can be reduced. Furthermore, assembly man-hours can be reduced by reducing the number of components.

In the present embodiment, the first fastening surfaces 731*s* are orthogonal to the second fastening surfaces 732*s* and the third fastening surfaces 733*s*. Accordingly, the image forming apparatus 100 can have high rigidity as compared to a configuration in which the first fastening surfaces 731*s*, the second fastening surfaces 732*s*, and the third fastening surfaces 733*s* are parallel to one another.

Next, a configuration of the sheet conveyor device 7 according to the present embodiment is further described with reference to FIGS. 9 to 11.

Figure 9:
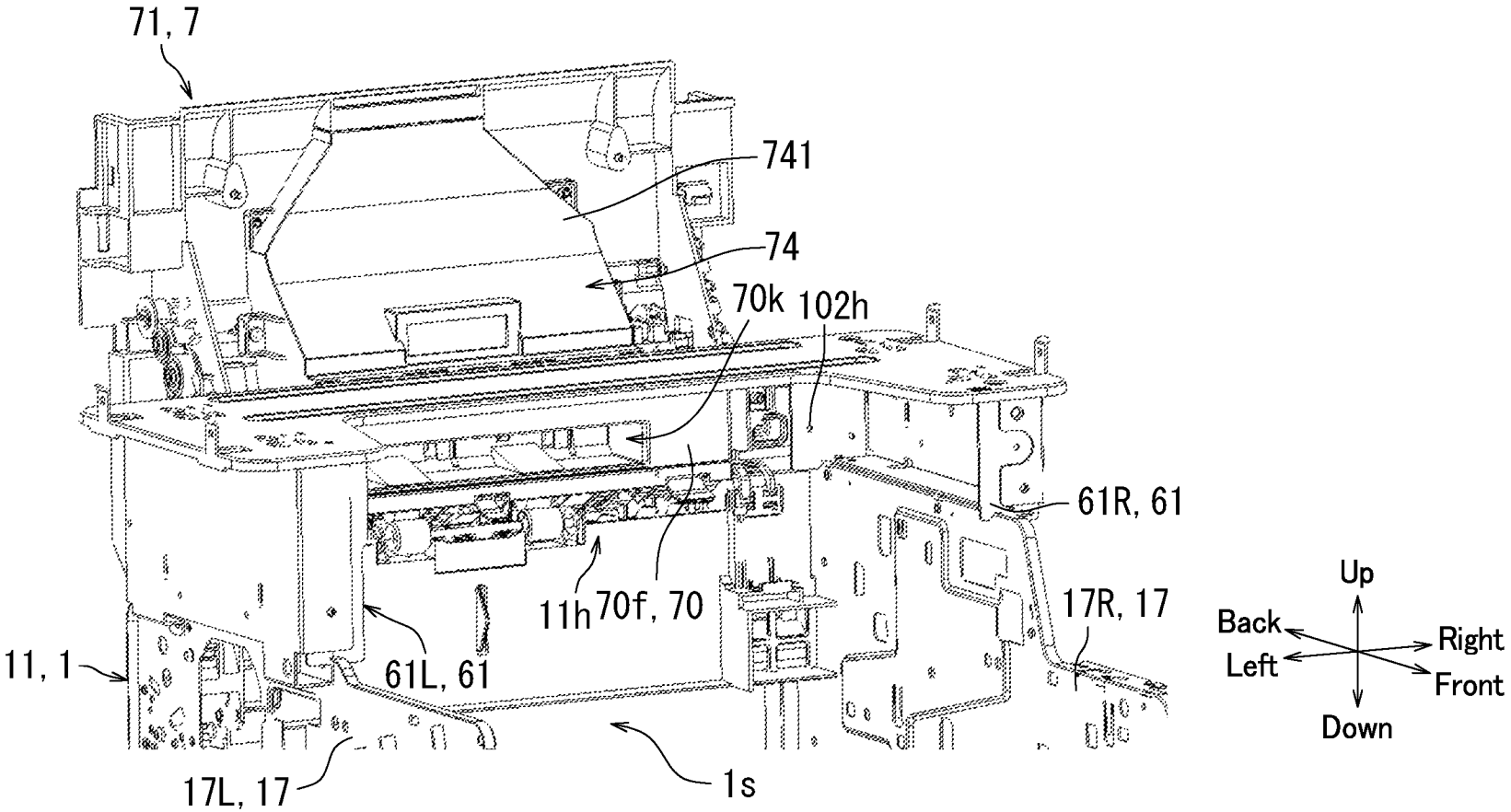
FIG. 9 is a diagram illustrating a configuration of a region of a sheet conveyor device according to the embodiment of the present disclosure.

FIG. 9 is a diagram illustrating a configuration of a region of the sheet conveyor device 7 according to the present embodiment. In detail, FIG. 9 illustrates the region of the sheet conveyor device 7 as viewed from the front left of the image forming apparatus 100. FIG. 10 is an enlarged view illustrating a part of the first guide member 71 according to the present embodiment. In detail, FIG. 10 illustrates an upper portion of the first guide member 71 as viewed from the back left of the image forming apparatus 100.

As illustrated in FIG. 9, the sheet conveyor device 7 further includes a cooling section 74. The cooling section 74 includes a duct 741. The duct 741 is an example of a ventilation path.

The duct 741 has one end connected to a suction port 70*k*, and extends in an extending direction of the first guide member 71. The suction port 70*k* is located at a position of a front wall 70*f* of the conveyor device casing 70 facing the in-body space 1*s*. In the present embodiment, the suction port 70*k* is above the sheet exit port 11*h*.

Figure 10:
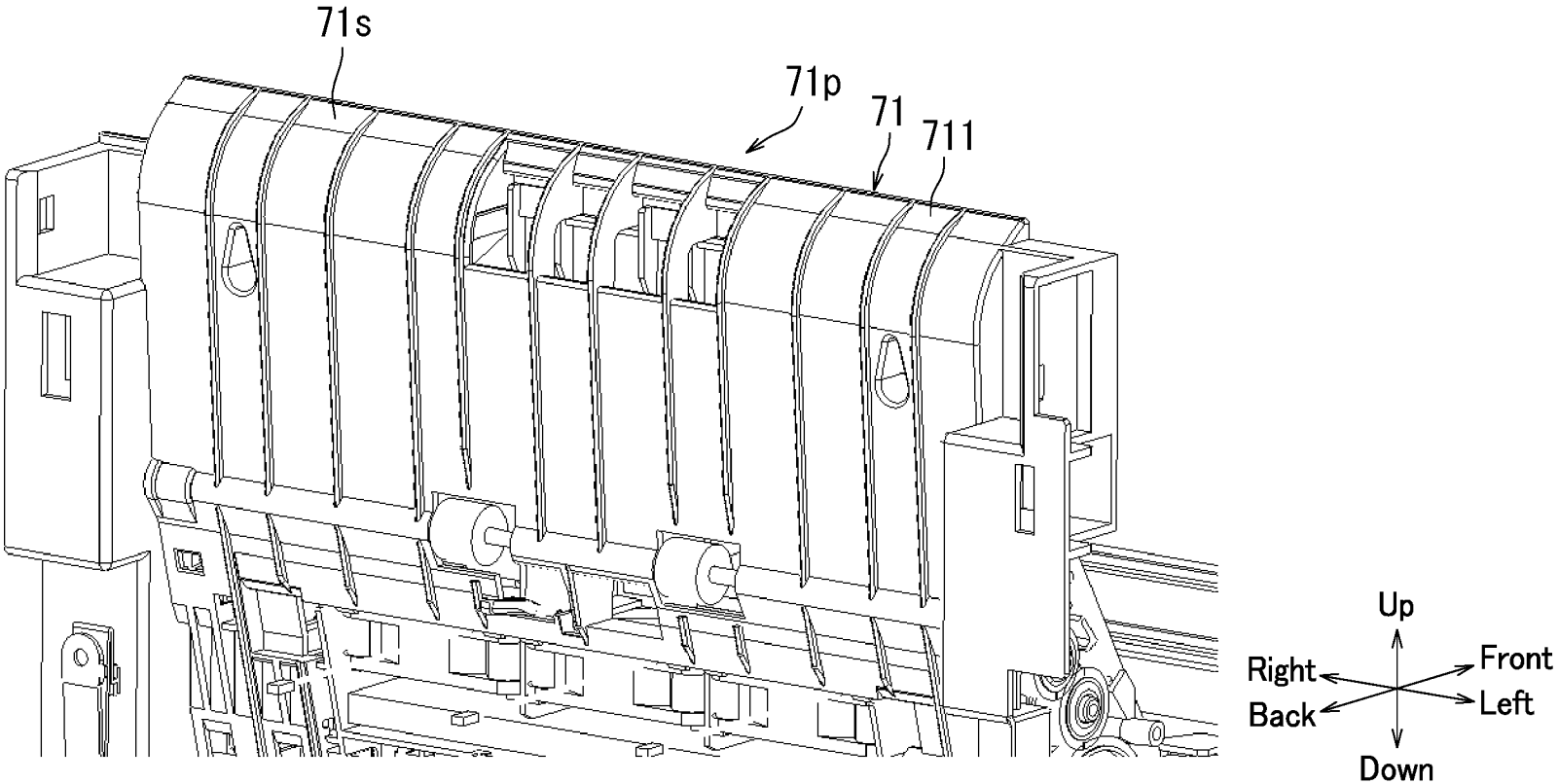
FIG. 10 is an enlarged view illustrating a part of the first guide member according to the embodiment of the present disclosure.

As illustrated in FIG. 10, the first guide member 71 has a first ventilation port 71*p*. The first ventilation port 71*p* is located in an upper edge part of the guide surface 71*s*. The first ventilation port 71*p* is connected to the other end of the duct 741 described with reference to FIG. 9.

Figure 11:
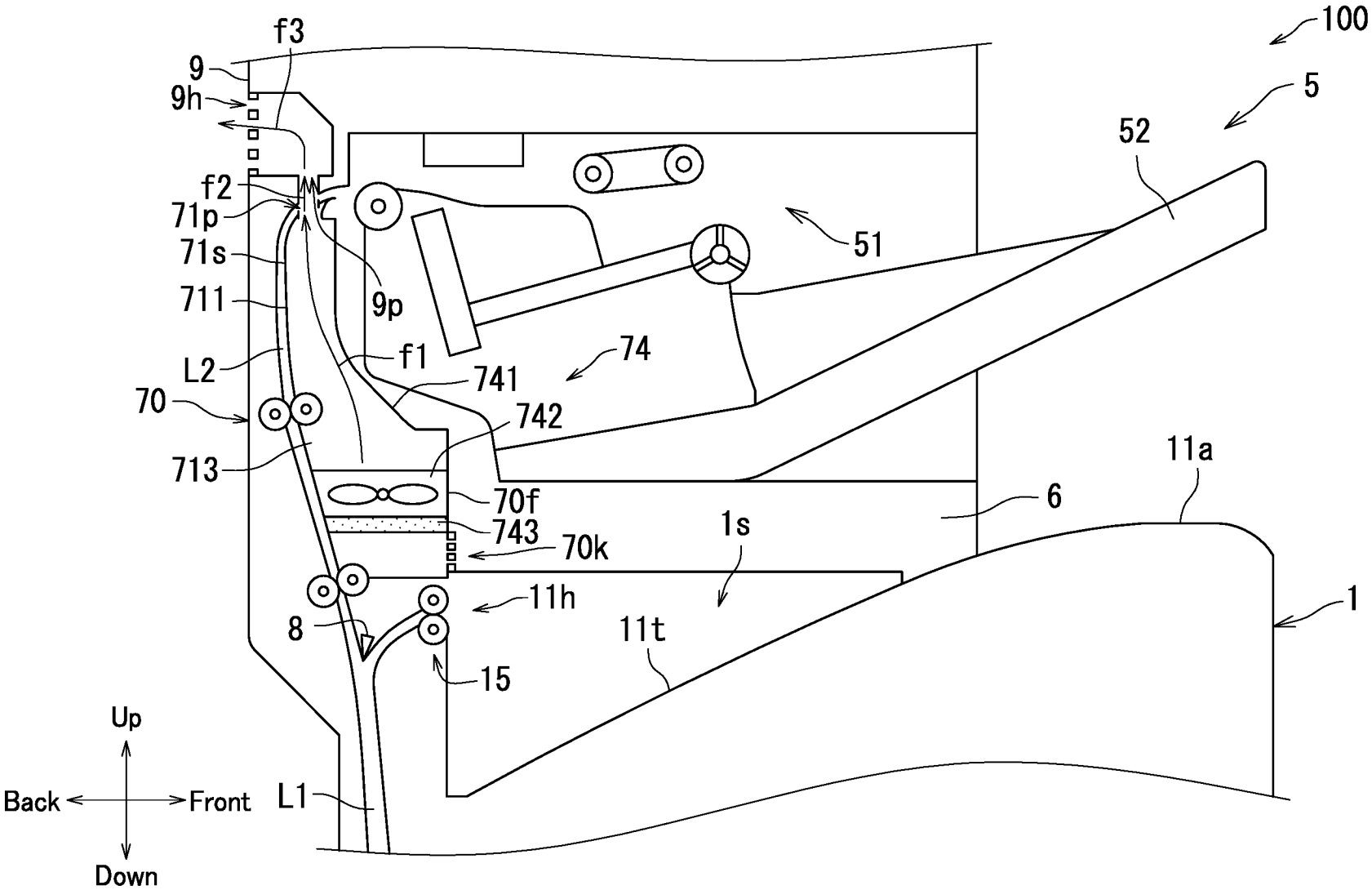
FIG. 11 is a schematic illustration of a region of the sheet conveyor device according to the embodiment of the present disclosure.

FIG. 11 is a schematic illustration of a region of the sheet conveyor device 7 according to the present embodiment.

As illustrated in FIG. 11, the cooling section 74 includes a suction fan 742 (an example of a fan) and a filter 743 in addition to the duct 741. The suction fan 742 and the filter 743 are located inside of the duct 741.

The suction fan 742 draws air from the in-body space 1*s* through the suction port 70*k* by spinning.

The filter 743 is located between the suction port 70*k* and the suction fan 742 inside of the duct 741. The filter 743 removes foreign objects such as particulates included in the air drawn from the suction port 70*k*.

The duct 741 channels the air drawn by the suction fan 742 to the first ventilation port 71*p*. The air drawn by the suction fan 742 flows through the duct 741 to the first ventilation port 71*p* as indicated by an arrow f1.

The duct 741 has a third guide section 713 which guides the conveyance of the sheet S. The third guide section 713 is provided by a portion of a back wall constituting the duct 741. When the first guide member 71 is coupled to the cooling section 74, the third guide section 713 is located between the first guide section 711 and the second guide section 712 as illustrated in FIG. 8.

The image forming apparatus 100 further includes a cover member 9. The cover member 9 has a second ventilation port 9*p* and an exhaust port 9*h*. The second ventilation port 9*p* is located at a position opposite to the first ventilation port 71*p*, crossing the second sheet conveyance path L2. The exhaust port 9*h* communicates with an exterior of the image forming apparatus 100.

The air that has flowed to the first ventilation port 71*p* in the direction indicated by the arrow f1 flows to the second ventilation port 9*p* across the second sheet conveyance path L2 as indicated by an arrow f2. In other words, a wind path created by the cooling section 74 intersects with the guide surface 71*s*. As described with reference to FIG. 2, the guide surface 71*s* is opposite to the image formation surface of the sheet S. Accordingly, the air crossing the second sheet conveyance path L2 is orthogonal to the image formation surface of the sheet S conveyed through the second sheet conveyance path L2. In the above configuration, the sheet S conveyed through the second sheet conveyance path L2 can be efficiently cooled. As a result, temperature inside of the finisher 5 can be prevented from increasing and curling in the sheet S can be reduced. Note that the air that has flowed to the second ventilation port 9*p* is discharged to the exterior of the image forming apparatus 100 through the exhaust port 9*h* as indicated by an arrow f3.

The embodiment of the present disclosure has been described above. According to the present embodiment, the image forming apparatus 100 can have high rigidity.

Also, in a configuration in which the sheet S is cooled by air flowing parallel to the image formation surface of the sheet S, a concern arises that the sheet S could be conveyed in a diagonal manner to cause skew or the like. By contrast, the air crossing the second sheet conveyance path L2 is orthogonal to the image formation surface of the sheet S conveyed through the second sheet conveyance path L2 in the present embodiment. Therefore, skew can be prevented from occurring.

Figure 12:
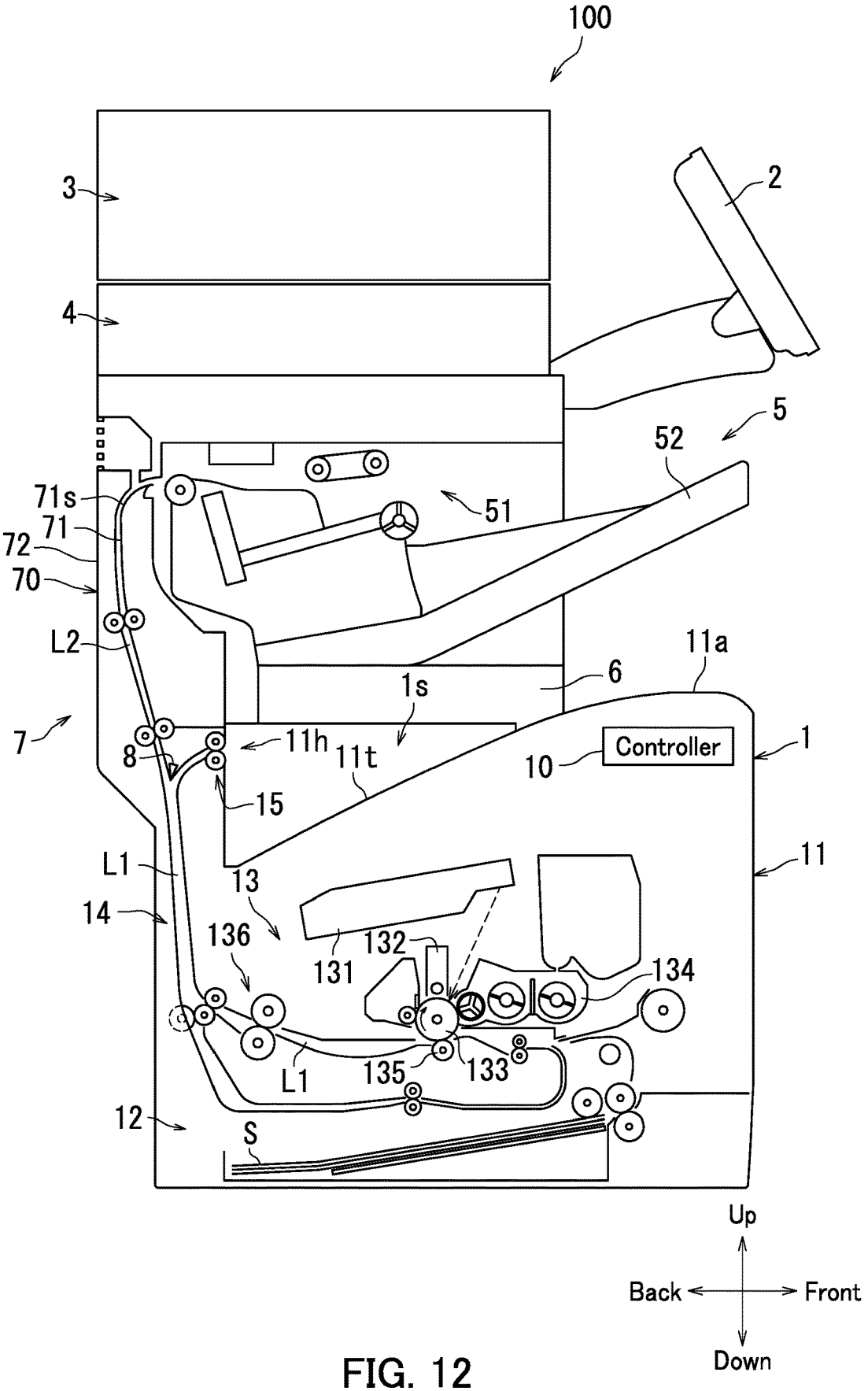
FIG. 12 is a diagram illustrating an additional example of the image forming apparatus according to the embodiment of the present disclosure.
Figure 13:
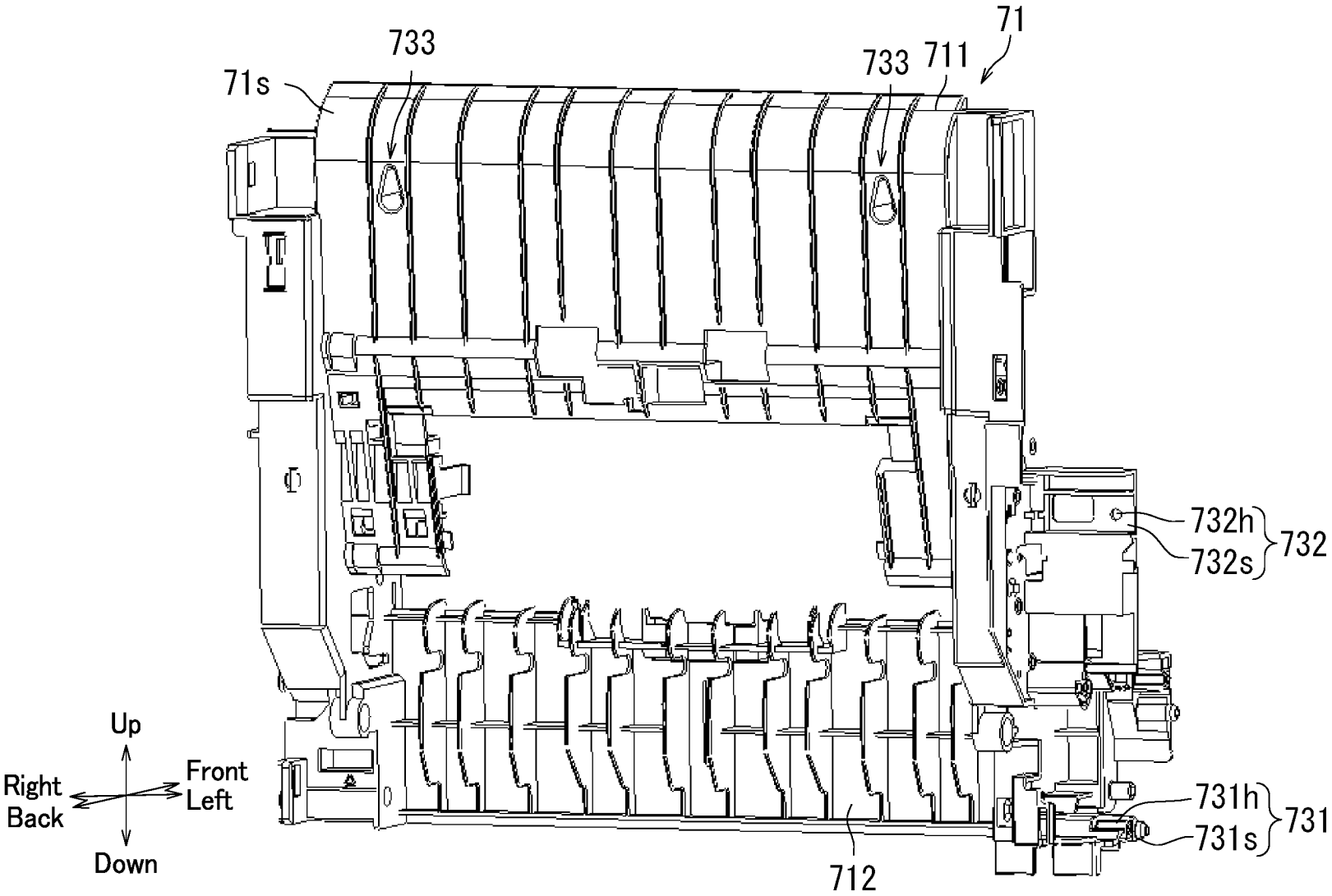
FIG. 13 is a diagram illustrating an additional example of the first guide member according to the embodiment of the present disclosure.

Note that in the present embodiment, a configuration has been described in which the sheet conveyor device 7 includes the cooling section 74, but the cooling section 74 may be omitted from the sheet conveyor device 7 as illustrated in FIGS. 12 and 13. FIG. 12 is a diagram illustrating an additional example of the image forming apparatus 100 according to the present embodiment. FIG. 13 is a diagram illustrating an additional example of the first guide member 71 according to the present embodiment. In a case in which the cooling section 74 is omitted as illustrated in FIG. 12, the first ventilation port 71*p* is also omitted as illustrated in FIG. 13.

Figure 14:
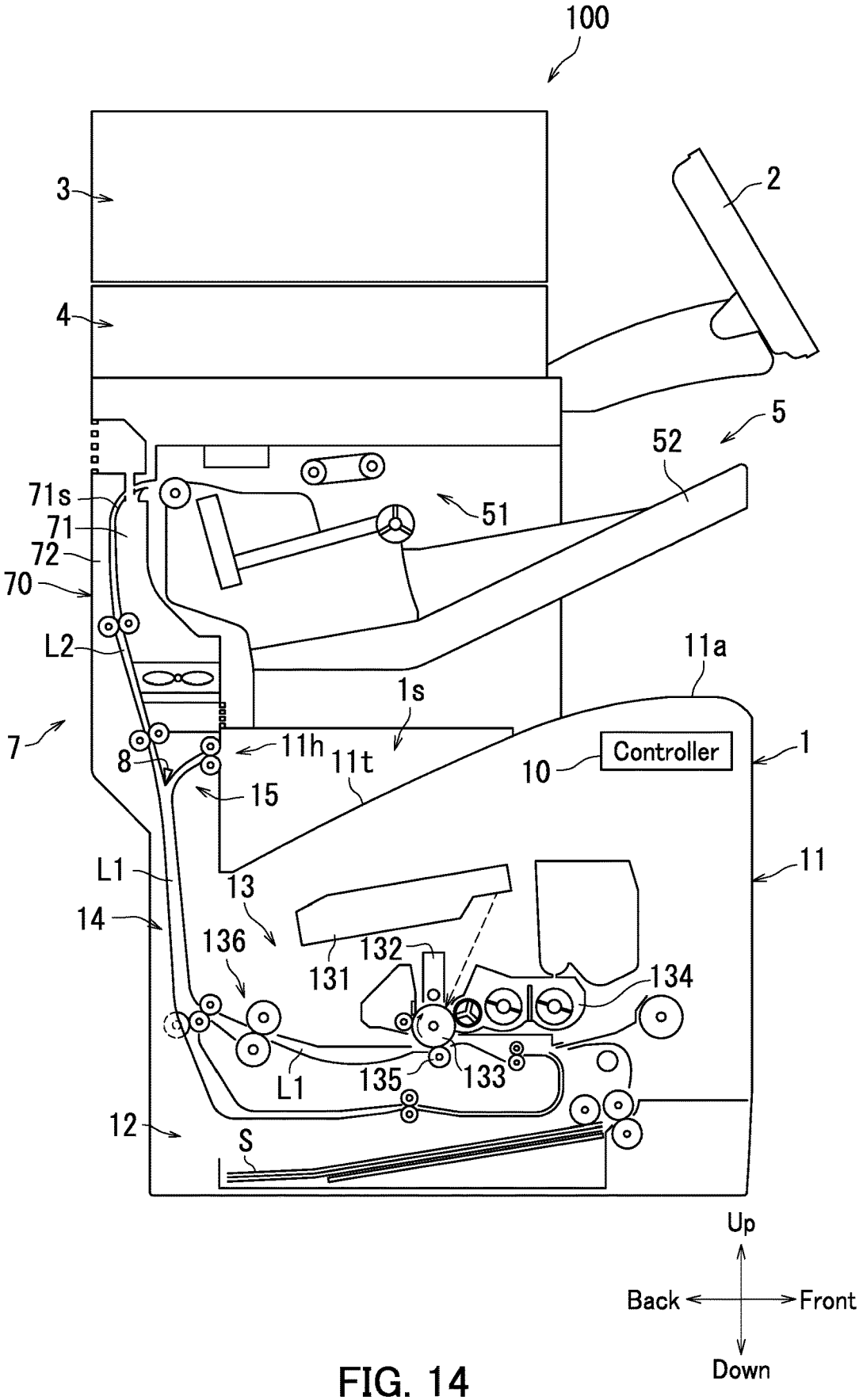
FIG. 14 is a diagram illustrating another additional example of the image forming apparatus according to the embodiment of the present disclosure.

As illustrated in FIG. 14, the coupling member 6 may be omitted from the image forming apparatus 100. FIG. 14 is a diagram illustrating another additional example of the image forming apparatus 100 according to the present embodiment. In a case in which the coupling member 6 is omitted, the first guide member 71 is fixed to the main body casing 11 and the finisher 5 as illustrated in FIG. 14.

The embodiment of the present disclosure has been described above with reference to the accompanying drawings (FIGS. 1 to 14). However, the present disclosure is not limited to the above embodiment and can be practiced in various ways within the scope not departing from the gist of the present disclosure. Furthermore, the configuration illustrated in the above embodiment is one example and not particularly limited. Various alterations are possible within a scope not substantially departing from the effects of the present disclosure.

For example, in the embodiment of the present disclosure, a case has been described in which the present disclosure is applied to an electrographic image forming apparatus. However, the present disclosure may be applied to a non-electrographic image forming apparatus such as an inkjet image forming apparatus.

What is claimed is:

1. An image forming apparatus, comprising:

an optional device configured to perform optional processing;

a casing;

an image forming section located inside of the casing and configured to form an image on a sheet;

a sheet conveying mechanism configured to convey, to a sheet exit port, the sheet with an image formed thereon by the image forming section;

an in-body space facing the sheet exit port, with an exit tray serving as a lower surface of the in-body space and an upper surface of the casing serving as the exit tray; and a sheet conveyor device configured to convey, from the sheet conveying mechanism to the optional device, the sheet with an image formed thereon by the image forming section, wherein the optional device and the casing are fixed to each other surrounding the in-body space, and the sheet conveyor device is fixed to the optional device and the casing.

2. The image forming apparatus according to claim 1, further comprising a coupling member located between the optional device and the casing, wherein the optional device and the casing are fixed to each other through the coupling member, and the sheet conveyor device is further fixed to the coupling member.

3. The image forming apparatus according to claim 1, wherein the sheet conveyor device has a first guide member and a second guide member which guide conveyance of the sheet, the first guide member and the second guide member are located opposite to each other, the first guide member has:

a casing fastening section fastened to the casing; and an optional device fastening section fastened to the optional device, the casing fastening member has a casing fastening surface, the optional device fastening member has an optional device fastening surface, the casing fastening surface is opposite to the casing, and the optional device fastening surface is opposite to the optional device.

4. The image forming apparatus according to claim 3, wherein the casing fastening surface is orthogonal to the optional device fastening surface.

5. The image forming apparatus according to claim 3, wherein the casing includes:

a first frame; and a second frame located opposite to the first frame, and the first frame and the second frame are opposite to the casing fastening surface.

6. The image forming apparatus according to claim 5, wherein the sheet conveyor device is located so as to be orthogonal to the first frame and the second frame, and is fixed to the first frame and the second frame.

7. The image forming apparatus according to claim 6, wherein the optional device has:

a first side wall;

a second side wall located opposite to the first side wall; and a mounting section located between the first side wall and the second side wall, the mounting section has a mounting hole and a mounting surface, and the sheet conveyor device is fixed to the optional device such that the optional device fastening surface is parallel to the mounting surface.

8. The image forming apparatus according to claim 1, wherein the sheet conveyor device has:

a guide surface which guides conveyance of the sheet; and a cooling section which cools the sheet, the cooling section includes:

a fan; and a ventilation path through which air flows by spinning of the fan, and the ventilation path intersects with the guide surface.

9. The image forming apparatus according to claim 1, wherein the upper surface of the casing and a lower surface of the optional device are opposite to each other with a space therebetween.

10. An image forming apparatus, comprising:

an optional device configured to perform optional processing;

a casing;

an image forming section located inside of the casing and configured to form an image on a sheet; and a sheet conveyor device configured to convey, to the optional device, the sheet with an image formed thereon by the image forming section, wherein the optional device and the casing are fixed to each other, the sheet conveyor device is fixed to the optional device and the casing, the sheet conveyor device has:

a guide surface which guides conveyance of the sheet; and a cooling section which cools the sheet, the cooling section includes:

a fan; and a ventilation path through which air flows by spinning of the fan, and the ventilation path intersects with the guide surface.

* * * * *